US006380143B1

(12) United States Patent
Kvietok et al.

(10) Patent No.: US 6,380,143 B1
(45) **Date of Patent: *Apr. 30, 2002**

(54) DETERGENT COMPOSITION WITH A SELECTED SURFACTANT SYSTEM CONTAINING A MID-CHAIN BRANCHED SURFACTANT

(76) Inventors: Frank Andrej Kvietok; Gabor Heltovics; Rinko Katsuda; Kenneth William Willman, all of The Procter & Gamble Company, Ivorydale Technical Center 5299 Spring Grove Ave., Cincinnati, OH (US) 45217

( * ) Notice: Subject to any disclaimer, the term of this patent is extended or adjusted under 35 U.S.C. 154(b) by 0 days.

This patent is subject to a terminal disclaimer.

(21) Appl. No.: 09/529,266

(22) PCT Filed: Oct. 9, 1998

(86) PCT No.: PCT/US98/21495

§ 371 Date: Apr. 10, 2000

§ 102(e) Date: Apr. 10, 2000

(87) PCT Pub. No.: WO99/19437

PCT Pub. Date: Apr. 22, 1999

Related U.S. Application Data

(60) Provisional application No. 60/061,881, filed on Oct. 10, 1997.

(51) Int. Cl.[7] ..... L11D 17/00

(52) U.S. Cl. ..... 510/357; 510/424; 510/426; 510/427; 510/428

(58) Field of Search ..... 510/357, 426, 510/427, 428, 424

(56) References Cited

U.S. PATENT DOCUMENTS

| | | | | | |
|---|---|---|---|---|---|
| 6,015,781 | A | * | 1/2000 | Vinson et al. | 510/302 |
| 6,046,152 | A | * | 4/2000 | Vinson et al. | 510/428 |
| 6,087,309 | A | * | 7/2000 | Vinson et al. | 510/125 |
| 6,133,222 | A | * | 10/2000 | Vinson et al. | 510/428 |

FOREIGN PATENT DOCUMENTS

| | | | |
|---|---|---|---|
| WO | WO 97/39088 | 10/1997 | C11D/1/14 |
| WO | WO 97/39091 | 10/1997 | C22D/1/14 |

* cited by examiner

*Primary Examiner*—Necholus Ogden
(74) *Attorney, Agent, or Firm*—Frank Taffy; Marianne Dressman; Steve W. Miller

(57) ABSTRACT

A detergent composition, having a selected surfactant system for improved performance, especially under high water hardness and low temperature wash water conditions is disclosed. The detergent composition includes a mid-chain branched primary alkyl sulfate surfactant in combination with a linear alkylbenzene sulfonate surfactant, and linear alkyl sulfate surfactant at optimally selected relative proportions. Additionally, the detergent composition contains up to about 5% of an alkyl ethoxylated sulfate surfactant and up to about 5% of a nonionic surfactant while unexpectedly having improved performance with such relatively low levels of a nonionic surfactant.

11 Claims, No Drawings

DETERGENT COMPOSITION WITH A SELECTED SURFACTANT SYSTEM CONTAINING A MID-CHAIN BRANCHED SURFACTANT

This Appln is a 371 of PCT/US98/21495 filed Oct. 9, 1998 which claims benefit of Prov. No. 60/061,881 filed Oct. 10, 1997.

FIELD OF THE INVENTION

The present invention generally relates to a detergent composition having a selected surfactant system for improved performance. More particularly, the detergent composition includes a mid-chain branched primary alkyl sulfate surfactant in combination with a linear alkylbenzene sulfonate surfactant, and linear alkyl sulfate surfactant resulting in surfactant system which causes the composition to have improved cleaning performance, especially under low water temperature wash conditions.

BACKGROUND OF THE INVENTION

Conventional detersive surfactants comprise molecules having a water-solubilizing substituent (hydrophilic group) and an oleophilic substituent (hydrophobic group). Such surfactants typically comprise hydrophilic groups such as carboxylate, sulfate, sulfonate. amine oxide, polyoxyethylene, and the like, attached to an alkyl, alkenyl or alkaryl hydrophobe usually containing from about 10 to about 20 carbon atoms. Accordingly, the manufacturer of such surfactants must have access to a source of hydrophobe groups to which the desired hydrophile can be attached by chemical means. The earliest source of hydrophobe groups comprised the natural fats and oils, which were converted into soaps (i.e., carboxylate hydrophile) by saponification with base. Coconut oil and palm oil are still used to manufacture soap, as well as to manufacture the alkyl sulfate ("AS") class of surfactants. Other hydrophobes are available from petrochemicals, including alkylated benzene which is used to manufacture alkyl benzene sulfonate surfactants ("LAS").

Generally, alkyl sulfates are well known to those skilled in the art of detersive surfactants. Alkyl sulfates were developed as a functional improvement over traditional soap surfactants and have been found to possess improved solubility and surfactant characteristics. Linear alkyl sulfates are the most commonly used of the alkyl sulfate surfactants and are the easiest to obtain. For example, long-chain linear alkyl sulfates, such as tallow alkyl sulfate, have been used in laundry detergents. However, these have significant cleaning performance limitations, especially with the trend to lower wash temperatures.

Accordingly, there is a need for a detergent composition which includes a surfactant capable of delivering improved cleaning at low wash water temperatures (e.g., 20° C.–5° C.). Moreover, even detergent compositions containing surfactants having the desired performance have room for improved performance. In particular, certain detergent compositions containing selected surfactants such as mid-chain branched surfactants typically include other ingredients such as builders, enzymes and the like which can have deleterious effects on the overall cleaning performance of the composition. To that end, a need continues to exist for a detergent composition which exhibits improved performance, especially at low temperature wash water and under relatively high water hardness conditions.

BACKGROUND ART

U.S. Pat. No. 3,480,556 to deWitt, et al., Nov. 25, 1969, EP 439,316, published by Lever Jul. 31, 1991, and EP 684,300, published by Lever Nov. 29, 1995, describe beta-branched alkyl sulfates. EP 439,316 describes certain laundry detergents containing a specific commercial C14/C15 branched primary alkyl sulfate, namely LIAL 145 sulfate. This is believed to have 61% branching in the 2-position; 30% of this involves branching with a hydrocarbon chain having four or more carbon atoms. U.S. Pat. No. 3,480,556 describes mixtures of from 10 to 90 parts of a straight chain primary alkyl sulfate and from 90 to 10 parts of a beta branched (2-position branched) primary alcohol sulfate of formula:

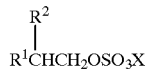

wherein the total number of carbon atoms ranges from 12 to 20 and R1 is a straight chain alkyl radical containing 9 to 17 carbon atoms and R2 is a straight chain alkyl radical containing 1 to 9 carbon atoms (67% 2-methyl and 33% 2-ethyl branching is exemplified).

As noted hereinbefore, R. G. Laughlin in "The Aqueous Phase Behavior of Surfactants", Academic Press, N.Y. (1994) p. 347 describes the observation that as branching moves away from the 2-alkyl position towards the center of the alkyl hydrophobe there is a lowering of Krafft temperatures. See also Finger et al., "Detergent alcohols—the effect of alcohol structure and molecular weight on surfactant properties", J. Amer. Oil Chemists' Society, Vol. 44, p. 525 (1967) and Technical Bulletin, Shell Chemical Co., SC: 364–80.

EP 342,917 A, Unilever, published Nov. 23, 1989 describes laundry detergents containing a surfactant system in which the major anionic surfactant is an alkyl sulfate having an assertedly "wide range" of alkyl chain lengths (the experimental appears to involve mixing coconut and tallow chain length surfactants).

U.S. Pat. No. 4,102,823 and GB 1,399,966 describe other laundry compositions containing conventional alkyl sulfates.

G.B. Patent 1,299,966, Matheson et al., published Jul. 2, 1975, discloses a detergent composition in which the surfactant system is comprised of a mixture of sodium tallow alkyl sulfate and nonionic surfactants.

Methyl- substituted sulfates include the known "isostearyl" sulfates; these are typically mixtures of isomeric sulfates having a total of 18 carbon atoms. For example, EP 401,462 A, assigned to Henkel, published Dec. 12, 1990, describes certain isostearyl alcohols and ethoxylated isostearyl alcohols and their sulfation to produce the corresponding alkyl sulfates such as sodium isostearyl sulfate. See also K. R. Wormuth and S. Zushma, Langmuir, Vol. 7, (1991), pp 2048–2053 (technical studies on a number of branched alkyl sulfates, especially the "branched Guerbet" type); R. Varadaraj et al., J. Phys. Chem., Vol. 95, (1991), pp 1671–1676 (which describes the surface tensions of a variety of "linear Guerbet" and "branched Guerbet"—class surfactants including alkyl sulfates); Varadaraj et al., J. Colloid and Interface Sci., Vol. 140, (1990), pp 31–34 (relating to foaming data for surfactants which include C12 and C13 alkyl sulfates containing 3 and 4 methyl branches, respectively); and Varadaraj et al., Langmuir, Vol. 6 (1990), pp 1376–1378 (which describes the micropolarity of aqueous micellar solutions of surfactants including branched alkyl sulfates).

"Linear Guerbet" alcohols are available from Henkel, e.g., EUTANOL G-16.

Primary akyl sulfates derived from alcohols made by Oxo reaction on propylene or n-butylene oligomers are described in U.S. Pat. No. 5,245,072 assigned to Mobil Corp. See also: U.S. Pat. No. 5,284,989, assigned to Mobil Oil Corp. (a method for producing substantially linear hydrocarbons by oligomerizing a lower olefin at elevated temperatures with constrained intermediate pore siliceous acidic zeolite), and U.S. Pat. Nos. 5,026,933 and 4,870,038, both to Mobil Oil Corp. (a process for producing substantially linear hydrocarbons by oligomerizing a lower olefin at elevated temperatures with siliceous acidic ZSM-23 zeolite).

See also: Surfactant Science Series, Marcel Dekker, N.Y. (various volumes include those entitled "Anionic Surfactants" and "Surfactant Biodegradation", the latter by R. D. Swisher, Second Edition, publ. 1987 as Vol. 18; see especially p.20–24 "Hydrophobic groups and their sources"; pp 28–29 "Alcohols", pp 34–35 "Primary Alkyl Sulfates" and pp 35–36 "Secondary Alkyl Sulfates"); and literature on "higher" or "detergent" alcohols from which alkyl sulfates are typically made, including: CEH Marketing Research Report "Detergent Alcohols" by R. F. Modler et al., Chemical Economics Handbook, 1993, 609.5000–609.5002; Kirk Othmer's Encyclopedia of Chemical Technology, 4th Edition, Wiley, N.Y., 1991, "Alcohols, Higher Aliphatic" in Vol. 1, pp 865–913 and references therein.

SUMMARY OF THE INVENTION

The invention meets the needs in the art by providing a detergent composition, having a selected surfactant system for improved performance, especially under high water hardness and low temperature wash water conditions. The detergent composition includes a mid-chain branched primary alkyl sulfate surfactant ("MBAS") in combination with a linear alkylbenzene sulfonate surfactant ("LAS"), and linear alkyl sulfate surfactant ("AS") at optimally selected relative proportions. Additionally, the detergent composition contains up to about 5% of an alkyl ethoxylated sulfate surfactant and up to about 5% of a nonionic surfactant (e.g., alkyl ethoxylate sulfate surfactant ("AE")) while unexpectedly having improved performance with such relatively low levels of a nonionic surfactant.

In accordance with one aspect of the invention, a detergent composition is provided. The detergent composition comprises: (A) a linear alkylbenzene sulfonate surfactant; (B) a mid-chain branched surfactant, wherein the weight ratio of the linear alkylbenzene sulfonate surfactant to the mid-chain branched surfactant is from about 1:3 to about 4:1; (C) a linear alkyl sulfate surfactant, wherein the weight ratio of the linear alkylbenzene sulfonate surfactant to the linear alkyl sulfate surfactant is from about 2:1 to about 20:1; (D) up to about 5% by weight of an alkyl ethoxylate surfactant; and (E) up to about 5% by weight of alkyl ethoxylated sulfate surfactant; wherein the mid-chain branched surfactant has the formula $$A^b—X—B$$

wherein (a) $A^b$ is a hydrophobic C9 to C22, total carbons in the moiety, preferably from about C12 to about C18, mid-chain branched alkyl moiety having: (1) a longest linear carbon chain attached to the —X—B moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon, counting from carbon #1 which is attached to the —X—B moiety, to position ω−2 carbon, the terminal carbon minus 2 carbons; and (4) the surfactant composition has an average total number of carbon atoms in the $A^b$—X moiety in the above formula within the range of greater than 14.5 to about 18; (b) B is a hydophilic moiety selected from sulfates, sulfonates, amine oxides, polyoxyalkylene, alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated quats, alkylated/polyhydroxylated oxypropyl quats, imidazolines, 2-yl-succinates, sulfonated alkyl esters, and sulfonated fatty acids; and (c) X is —$CH_2$—. The invention also provides a method of laundering soiled fabrics comprising the step of contacting the soiled fabrics with an effective amount of a composition as described herein in an aqueous solution.

Accordingly, it is an object of the present invention to provide a detergent compositions containing an improved surfactant system which exhibits improved cleaning at low wash water temperatures and increased resistance to water hardness. It is also an object of the invention to provide a detergent composition which cleans across a wider range of soils and stains and which is more stable with other detergent ingredients such as enzymes.

All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The invention is directed to a detergent composition, preferably granular, which contains a mid-chain branched surfactant as detailed hereinafter and an assortment of other surfactants which have been judiciously selected for inclusion in the detergent composition to render optimal performance. Specifically, the composition includes a linear alkylbenzene sulfonate surfactant which can have a variety of chain lengths as detailed hereinafter, the aforementioned mid-chain branched surfactant, and a linear alkyl sulfate surfactant. It has been found that by including such surfactants in selected weight ratios, unexpectedly superior cleaning performance is achieved by the composition of the invention. Unexpectedly, it has also been found that the relative levels of nonionic surfactant, such as alkyl ethoxylate, in the composition can be reduced without negatively impacting performance. Although optional, it has also unexpectedly been found that detergent composition of the invention can be substantially free of alkyl ethoxylate and alkyl ethoxylated sulfate surfactants without deleteriously affecting the overall cleaning performance of the composition.

Preferably, the weight ratio of said linear alkylbenzene sulfonate surfactant to said mid-chain branched surfactant is from about 1:3 to about 4:1, more preferably from about 1:1 to about 3:1, most preferably from about 2:1 to about 3:1. Additionally, the weight ratio of the linear alkylbenzene sulfonate surfactant to the linear alkyl sulfate surfactant is from about 2:1 to about 20:1, more preferably from about 4:1 to about 10:1, most preferably from about 5:1 to about 8:1. The detergent composition of the invention also includes up to about 5% by weight of an alkyl ethoxylated sulfate surfactant and up to about 5% of an alkyl ethoxylate surfactant, preferably from about 0.01% to about 4%, most preferably from about 0.1% to about 3%, by weight of the composition.

Optionally, the detergent composition of the invention can include adjunct detergent ingredients selected from the group consisting of builders, enzymes, fillers, brighteners, bleaching agents and mixtures thereof. Preferred adjunct detergent ingredients are selected from the group consisting of polyethylene glycol, polyacrylate and mixtures thereof. Additional preferred adjunct detergent ingredients are selected from the group consisting of builders, enzymes, fillers, brighteners, bleaching agents and mixtures thereof.

The surfactant system of the composition includes a mid-chain branched surfactant as follows. In such surfactants, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties useful according to the present invention.

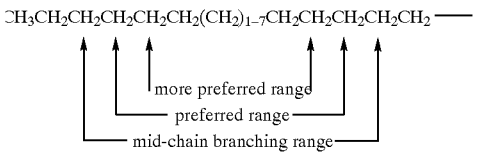

It should be noted that for the mono-methyl substituted surfactants these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties useful according to the present invention.

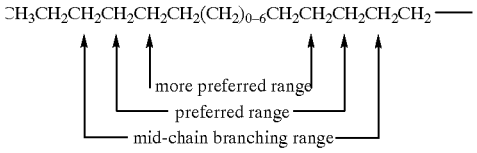

The preferred branched surfactant compositions useful in detergent compositions according to the present invention are described in more detail hereinafter.

(1) Mid-chain Branched Primary Alkyl Sulfate Surfactants

The present invention branched surfactant-containing compositions may comprise two or more mid-chain branched primary alkyl sulfate surfactants having the formula

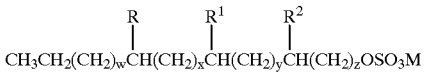

The surfactant mixtures of the present invention comprise molecules having a linear primary alkyl sulfate chain backbone (i.e., the longest linear carbon chain which includes the sulfated carbon atom). These alkyl chain backbones comprise from 12 to 19 carbon atoms; and further the molecules comprise a branched primary alkyl moiety having at least a total of 14, but not more than 20, carbon atoms. In addition, the surfactant mixture has an average total number of carbon atoms for the branched primary alkyl moieties within the range of from greater than 14.5 to about 17.5. Thus, the present invention mixtures comprise at least one branched primary alkyl sulfate surfactant compound having a longest linear carbon chain of not less than 12 carbon atoms or more than 19 carbon atoms, and the total number of carbon atoms including branching must be at least 14, and further the average total number of carbon atoms for the branched primary alkyl chains is within the range of greater than 14.5 to about 17.5.

For example, a C16 total carbon primary alkyl sulfate surfactant having 13 carbon atoms in the backbone must have 1, 2, or 3 branching units (i.e., R, $R^1$ and/or $R^2$) whereby total number of carbon atoms in the molecule is at least 16. In this example, the C16 total carbon requirement may be satisfied equally by having, for example, one propyl branching unit or three methyl branching units.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

Although for the purposes of the present invention surfactant compositions the above formula does not include molecules wherein the units R, $R^1$, and $R^2$ are all hydrogen (i.e., linear non-branched primary alkyl sulfates), it is to be recognized that the present invention compositions may still further comprise some amount of linear, non-branched primary alkyl sulfate. Further, this linear non-branched primary alkyl sulfate surfactant may be present as the result of the process used to manufacture the surfactant mixture having the requisite one or more mid-chain branched primary alkyl sulfates according to the present invention, or for purposes of formulating detergent compositions some amount of linear non-branched primary alkyl sulfate may be admixed into the final product formulation.

Further it is to be similarly recognized that non-sulfated mid-chain branched alcohol may comprise some amount of the present invention compositions. Such materials may be present as the result of incomplete sulfation of the alcohol used to prepare the alkyl sulfate surfactant, or these alcohols may be separately added to the present invention detergent compositions along with a mid-chain branched alkyl sulfate surfactant according to the present invention.

M is hydrogen or a salt forming cation depending upon the method of synthesis. Examples of salt forming cations are lithium, sodium, potassium, calcium, magnesium, quaternary alkyl amines having the formula

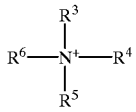

wherein $R^3$, $R^4$, $R^5$ and $R^6$ are independently hydrogen, $C_1$–$C_{22}$ alkylene, $C_4$–$C_{22}$ branched alkylene, $C_1$–$C_6$ alkanol, $C_1$–$C_{22}$ alkenylene, $C_4$–$C_{22}$ branched alkenylene, and mixtures thereof. Preferred cations are ammonium ($R^3$, $R^4$, $R^5$ and $R^6$ equal hydrogen), sodium, potassium, mono-, di-, and trialkanol ammonium, and mixtures thereof. The monoalkanol ammonium compounds of the present invention have $R^3$ equal to $C_1$–$C_6$ alkanol, $R^4$, $R^5$ and $R^6$ equal to hydrogen;

dialkanol ammonium compounds of the present invention have $R^3$ and $R^4$ equal to $C_1$–$C_6$ alkanol, $R^5$ and $R^6$ equal to hydrogen; trialkanol ammonium compounds of the present invention have $R^3$, $R^4$ and $R^5$ equal to $C_1$–$C_6$ alkanol, $R^6$ equal to hydrogen. Preferred alkanol ammonium salts of the present invention are the mono-, di- and tri- quaternary ammonium compounds having the formulas:

$$H_3N^+CH_2CH_2OH,\ H_2N^+(CH_2CH_2OH)_2,\ HN^+(CH_2CH_2OH)_3.$$

Preferred M is sodium, potassium and the $C_2$ alkanol ammonium salts listed above; most preferred is sodium.

Further regarding the above formula, w is an integer from 0 to 13; x is an integer from 0 to 13; y is an integer from 0 to 13; z is an integer of at least 1; and w+x+y+z is an integer from 8 to 14.

The preferred surfactant mixtures of the present invention have at least 0.001%, more preferably at least 5%, most preferably at least 20% by weight, of the mixture one or more branched primary alkyl sulfates having the formula $$CH_3CH_2(CH_2)_x\overset{\overset{\displaystyle R^1}{|}}{C}H(CH_2)_y\overset{\overset{\displaystyle R^2}{|}}{C}H(CH_2)_zOSO_3M$$

wherein the total number of carbon atoms, including branching, is from 15 to 18, and wherein further for this surfactant mixture the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11 ; y is from 0 to 11; z is at least 2; and x+y+z is from 9 to 13; provided $R^1$ and $R^2$ are not both hydrogen. More preferred are compositions having at least 5% of the mixture comprising one or more mid-chain branched primary alkyl sulfates wherein x+y is equal to 9 and z is at least 2.

Preferably, the mixtures of surfactant comprise at least 5% of a mid chain branched primary alkyl sulfate having $R^1$ and $R^2$ independently hydrogen, methyl, provided $R^1$ and $R^2$ are not both hydrogen; x+y is equal to 8, 9, or 10 and z is at least 2. More preferably the mixtures of surfactant comprise at least 20% of a mid chain branched primary alkyl sulfate having $R^1$ and $R^2$ independently hydrogen, methyl, provided $R^1$ and $R^2$ are not both hydrogen; x+y is equal to 8, 9, or 10 and z is at least 2.

Preferred detergent compositions according to the present invention, for example one useful for laundering fabrics, comprise from about 0.001% to about 99% of a mixture of mid-chain branched primary alkyl sulfate surfactants, said mixture comprising at least about 5% by weight of two or more mid-chain branched alkyl sulfates having the formula:

$$CH_3(CH_2)_a\overset{\overset{\displaystyle CH_3}{|}}{C}H(CH_2)_bCH_2OSO_3M, \quad \text{(I)}$$

$$CH_3(CH_2)_d\overset{\overset{\displaystyle CH_3}{|}}{C}H(CH_2)_e\overset{\overset{\displaystyle CH_3}{|}}{C}H_2OSO_3M, \quad \text{(II)}$$

or mixtures thereof; wherein M represents one or more cations; a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12;

wherein further for this surfactant mixture the average total number of carbon atoms in the branched primary alkyl moieties having the above formulas is within the range of greater than 14.5 to about 17.5.

Further, the present invention surfactant composition may comprise a mixture of branched primary alkyl sulfates having the formula $$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M$$

wherein the total number of carbon atoms per molecule, including branching, is from 14 to 20, and wherein further for this surfactant mixture the average total number of carbon atoms in the branched primary alkyl moieties having the above formula is within the range of greater than 14.5 to about 17.5; R, $R^1$, and $R^2$ are each independently selected from hydrogen and $C_1$–$C_3$ alkyl, provided R, $R^1$, and $R^2$ are not all hydrogen; M is a water soluble cation; w is an integer from 0 to 13; x is an integer from 0 to 13; y is an integer from 0 to 13; z is an integer of at least 1; and w+x+y+z is from 8 to 14; provided that when $R^2$ is a $C_1$–$C_3$ alkyl the ratio of surfactants having z equal to 1 to surfactants having z of 2 or greater is at least about 1:1, preferably at least about 1:5, more preferably at least about 1:10, and most preferably at least about 1:100. Also preferred are surfactant compositions, when $R^2$ is a $C_1$–$C_3$ alkyl, comprising less than about 20%, preferably less than 10%, more preferably less than 5%, most preferably less than 1%, of branched primary alkyl sulfates having the above formula wherein z equals 1.

Preferred mono-methyl branched primary alkyl sulfates are selected from the group consisting of: 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 11-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 11-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of: 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetradecanol sulfate, 2,11-methyl tetradecanol sulfate, 2,12-methyl tetradecanol sulfate, 2,3-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

The following branched primary alkyl sulfates comprising 16 carbon atoms and having one branching unit are examples of preferred branched surfactants useful in the present invention compositions:

5-methylpentadecylsulfate having the formula:

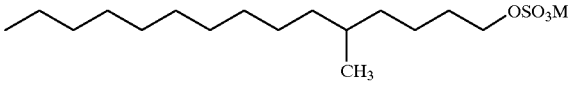

6-methylpentadecylsulfate having the formula

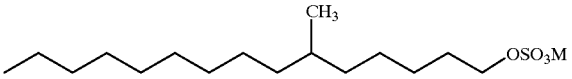

7-methylpentadecylsulfate having the formula

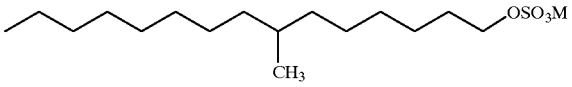

8-methylpentadecylsulfate having the formula

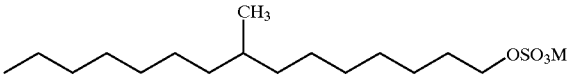

9-methylpentadecylsulfate having the formula

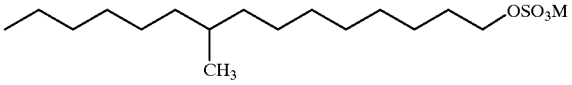

7-methylpentadecylsulfate having the formula

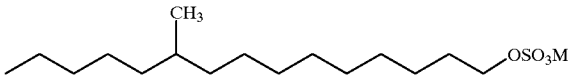

wherein M is preferably sodium.

The following branched primary alkyl sulfates comprising 17 carbon atoms and having two branching units are examples of preferred branched surfactants according to the present invention:

2,5-dimethylpentadecylsulfate having the formula:

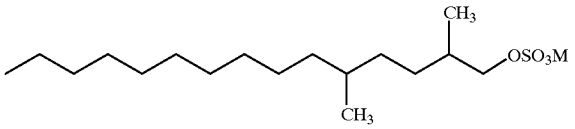

2,6-dimethylpentadecylsulfate having the formula

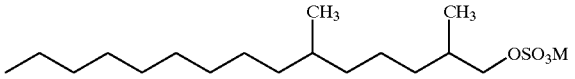

2,7-dimethylpentadecylsulfate having the formula

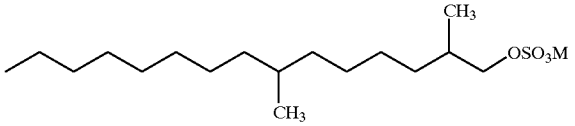

2,87-dimethylpentadecylsulfate having the formula

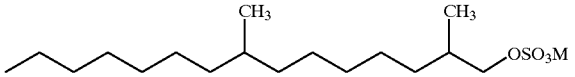

2,9-dim ethylpentadecylsulfate having the formula

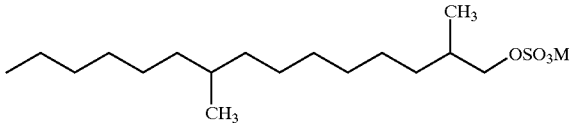

2,10-dimethylpentadecylsulfate having the formula

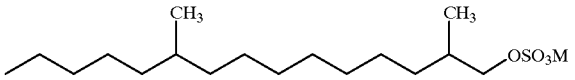

wherein M is preferably sodium.

(2) Mid-chain Branched Primary Alkyl Polyoxyalkylene Surfactants

The present invention branched surfactant-containing compositions may comprise one or more mid-chain branched primary alkyl polyoxyalkylene surfactants having the formula $$CH_3CH_2(CH_2)_wCH(R)(CH_2)_xCH(R^1)(CH_2)_yCH(R^2)(CH_2)_z(EO/PO)mOH$$

The surfactant mixtures of the present invention comprise molecules having a linear primary polyoxyalkylene chain backbone (i.e., the longest linear carbon chain which includes the alkoxylated carbon atom). These alkyl chain backbones comprise from 12 to 19 carbon atoms; and further the molecules comprise a branched primary alkyl moiety having at least a total of 14, but not more than 20, carbon atoms. In addition, the surfactant mixture has an average total number of carbon atoms for the branched primary alkyl moieties within the range of from greater than 14.5 to about 17.5. Thus, the present invention mixtures comprise at least one polyoxyalkylene compound having a longest linear carbon chain of not less than 12 carbon atoms or more than 19 carbon atoms, and the total number of carbon atoms including branching must be at least 14, and further the average total number of carbon atoms for the branched primary alkyl chains is within the range of greater than 14.5 to about 17.5.

For example, a C16 total carbon (in the alkyl chain) primary polyoxyalkylene surfactant having 15 carbon atoms in the backbone must have a methyl branching unit (either R, $R^1$ or $R^2$ is methyl) whereby the total number of carbon atoms in the molecule is 16.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

Although for the purposes of the present invention surfactant compositions the above formula does not include molecules wherein the units R, $R^1$, and $R^2$ are all hydrogen (i.e., linear non-branched primary polyoxyalkylenes), it is to be recognized that the present invention compositions may still further comprise some amount of linear, non-branched primary polyoxyalkylene. Further, this linear non-branched primary polyoxyalkylene surfactant may be present as the result of the process used to manufacture the surfactant mixture having the requisite mid-chain branched primary polyoxyalkylenes according to the present invention, or for purposes of formulating detergent compositions some amount of linear non-branched primary polyoxyalkylene may be admixed into the final product formulation.

Further it is to be similarly recognized that non-alkoxylated mid-chain branched alcohol may comprise some amount of the present invention polyoxyalkylene-containing compositions. Such materials may be present as the result of incomplete alkoxylation of the alcohol used to prepare the polyoxyalkylene surfactant, or these alcohols may be separately added to the present invention detergent compositions along with a mid-chain branched polyoxyalkylene surfactant according to the present invention.

Further regarding the above formula, w is an integer from 0 to 13; x is an integer from 0 to 13; y is an integer from 0 to 13; z is an integer of at least 1; and w+x+y+z is an integer from 8 to 14.

EO/PO are alkoxy moieties, preferably selected from ethoxy, propoxy, and mixed ethoxy/propoxy groups, more preferably ethoxy, wherein m is at least about 1, preferably within the range of from about 3 to about 30, more preferably from about 5 to about 20, and most preferably from about 5 to about 15. The $(EO/PO)_m$ moiety may be either a distribution with average degree of alkoxylation (e.g., ethoxylation and/or propoxylation) corresponding to m, or it may be a single specific chain with alkoxylation (e.g., ethoxylation and/or propoxylation) of exactly the number of units corresponding to m.

The preferred surfactant mixtures of the present invention have at least 0.001%, more preferably at least 5%, most preferably at least 20% by weight, of the mixture one or more mid-chain branched primary alkyl polyoxyalkylenes having the formula $$CH_3CH_2(CH_2)_xCH(R^1)(CH_2)_yCH(R^2)(CH_2)_z(EO/PO)mOH$$

wherein the total number of carbon atoms, including branching, is from 15 to 18, and wherein further for this surfactant mixture the average total number of carbon atoms in the branched primary alkyl moieties having the above formula is within the range of greater than 14.5 to about 17.5; $R^1$ and $R^2$ are each independently hydrogen or $C_1$–$C_3$ alkyl; x is from 0 to 11; y is from 0 to 11; z is at least 2; and x+y+z is from 9 to 13; provided $R^1$ and $R^2$ are not both hydrogen; and EO/PO are alkoxy moieties selected from ethoxy, propoxy, and mixed ethoxy/propoxy groups, more preferably ethoxy, wherein m is at least about 1, preferably within the range of from about 3 to about 30, more preferably from about 5 to about 20, and most preferably from about 5 to about 15. More preferred are compositions having at least 5% of the mixture comprising one or more mid-chain branched primary polyoxyalkylenes wherein z is at least 2.

Preferably, the mixtures of surfactant comprise at least 5%, preferably at least about 20%, of a mid chain branched primary alkyl polyoxyalkylene having $R^1$ and $R^2$ independently hydrogen or methyl, provided $R^1$ and $R^2$ are not both hydrogen; x+y is equal to 8, 9 or 10 and z is at least 2.

Preferred detergent compositions according to the present invention, for example one useful for laundering fabrics, comprise from about 0.001% to about 99% of a mixture of mid-chain branched primary alkyl polyoxyalkylene surfactants, said mixture comprising at least about 5% by weight of one or more mid-chain branched alkyl polyoxyalkylenes having the formula:

$$CH_3(CH_2)_aCH(CH_3)(CH_2)_bCH_2(EO/PO)mOH, \quad (I)$$

$$CH_3(CH_2)_dCH(CH_3)(CH_2)_eCH(CH_3)CH_2(EO/PO)mOH, \quad (II)$$

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12;

and wherein further for this surfactant mixture the average total number of carbon atoms in the branched primary alkyl moieties having the above formulas is within the range of greater than 14.5 to about 17.5; and EO/PO are alkoxy moieties selected from ethoxy, propoxy, and mixed ethoxy/propoxy groups, wherein m is at least about 1, preferably within the range of from about 3 to about 30, more preferably from about 5 to about 20, and most preferably from about 5 to about 15.

Further, the present invention surfactant composition may comprise a mixture of branched primary alkyl polyoxyalkylenes having the formula

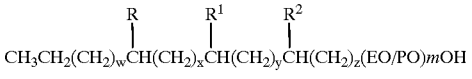

wherein the total number of carbon atoms per molecule, including branching, is from 14 to 20, and wherein further for this surfactant mixture the average total number of carbon atoms in the branched primary alkyl moieties having the above formula is within the range of greater than 14.5 to about 17.5; R, $R^1$, and $R^2$ are each independently selected from hydrogen and $C_1$–$C_3$ alkyl, provided R, $R^1$, and $R^2$ are not all hydrogen; w is an integer from 0 to 13; x is an integer from 0 to 13; y is an integer from 0 to 13; z is an integer of at least 1; w+x+y+z is from 8 to 14; EO/PO are alkoxy moieties, preferably selected from ethoxy, propoxy, and mixed ethoxy/propoxy groups, wherein m is at least about 1, preferably within the range of from about 3 to about 30, more preferably from about 5 to about 20, and most preferably from about 5 to about 15; provided that when $R^2$ is $C_1$–$C_3$ alkyl the ratio of surfactants having z equal to 2 or greater to surfactants having z of 1 is at least about 1:1, preferably at least about 1.5:1, more preferably at least about 3:1, and most preferably at least about 4:1. Also preferred are surfactant compositions when $R^2$ is $C_1$–$C_3$ alkyl comprising less than about 50%, preferably less than about 40%, more preferably less than about 25%, most preferably less than about 20%, of branched primary alkyl polyoxyalkylene having the above formula wherein z equals 1.

Preferred mono-methyl branched primary alkyl ethoxylates are selected from the group consisting of: 3-methyl pentadecanol ethoxylate, 4-methyl pentadecanol ethoxylate, 5-methyl pentadecanol ethoxylate, 6-methyl pentadecanol ethoxylate, 7-methyl pentadecanol ethoxylate, 8-methyl pentadecanol ethoxylate, 9-methyl pentadecanol ethoxylate, 10-methyl pentadecanol ethoxylate, 11-methyl pentadecanol ethoxylate, 12-methyl pentadecanol ethoxylate, 13-methyl pentadecanol ethoxylate, 3-methyl hexadecanol ethoxylate, 4-methyl hexadecanol ethoxylate, 5-methyl hexadecanol ethoxylate, 6-methyl hexadecanol ethoxylate, 7-methyl hexadecanol ethoxylate, 8-methyl hexadecanol ethoxylate, 9-methyl hexadecanol ethoxylate, 10-methyl hexadecanol ethoxylate, 16-methyl hexadecanol ethoxylate, 12-methyl hexadecanol ethoxylate, 13-methyl hexadecanol ethoxylate, 14-methyl hexadecanol ethoxylate, and mixtures thereof, wherein the compounds are ethoxylated with an average degree of ethoxylation of from about 5 to about 15.

Preferred di-methyl branched primary alkyl ethoxylates selected from the group consisting of: 2,3-methyl tetradecanol ethoxylate, 2,4-methyl tetradecanol ethoxylate, 2,5-methyl tetradecanol ethoxylate, 2,6-methyl tetradecanol ethoxylate, 2,7-methyl tetradecanol ethoxylate, 2,8-methyl tetradecanol ethoxylate, 2,9-methyl tetradecanol ethoxylate, 2,10-methyl tetradecanol ethoxylate, 2,11-methyl tetradecanol ethoxylate, 2,12-methyl tetradecanol ethoxylate, 2,3-methyl pentadecanol ethoxylate, 2,4-methyl pentadecanol ethoxylate, 2,5-methyl pentadecanol ethoxylate, 2,6-methyl pentadecanol ethoxylate, 2,7-methyl pentadecanol ethoxylate, 2,8-methyl pentadecanol ethoxylate, 2,9-methyl pentadecanol ethoxylate, 2,10-methyl pentadecanol ethoxylate, 2,11-methyl pentadecanol ethoxylate, 2,12-methyl pentadecanol ethoxylate, 2,13-methyl pentadecanol ethoxylate, and mixtures thereof, wherein the compounds are ethoxylated with an average degree of ethoxylation of from about 5 to about 15.

(3) Mid-chain Branched Primary Alkyl Alkoxylated Sulfate Surfactants

The present invention branched surfactant-containing compositions may comprise one or more (preferably a mixture of two or more) mid-chain branched primary alkyl alkoxylated sulfates having the formula:

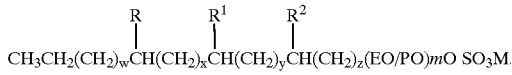

The surfactant mixtures of the present invention comprise molecules having a linear primary alkoxylated sulfate chain backbone (i.e., the longest linear carbon chain which includes the alkoxy-sulfated carbon atom). These alkyl chain backbones comprise from 12 to 19 carbon atoms; and further the molecules comprise a branched primary alkyl moiety having at least a total of 14, but not more than 20, carbon atoms. In addition, the surfactant mixture has an average total number of carbon atoms for the branched primary alkyl moieties within the range of from greater than 14.5 to about 17.5. Thus, the present invention mixtures comprise at least one alkoxylated sulfate compound having a longest linear carbon chain of not less than 12 carbon atoms or more than 19 carbon atoms, and the total number of carbon atoms including branching must be at least 14, and further the average total number of carbon atoms for the branched primary alkyl chains is within the range of greater than 14.5 to about 17.5.

For example, a C16 total carbon (in the alkyl chain) primary alkyl alkoxylated sulfate surfactant having 15 carbon atoms in the backbone must have a methyl branching unit (either R, $R^1$ or $R^2$ is methyl) whereby the total number of carbon atoms in the primary alkyl moiety of the molecule is 16.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

Although for the purposes of the present invention surfactant compositions the above formula does not include molecules wherein the units R, $R^1$, and $R^2$ are all hydrogen (i.e., linear non-branched primary alkoxylated sulfates), it is to be recognized that the present invention compositions may still further comprise some amount of linear, non-branched primary alkoxylated sulfate. Further, this linear non-branched primary alkoxylated sulfate surfactant may be present as the result of the process used to manufacture the surfactant mixture having the requisite mid-chain branched primary alkoxylated sulfates according to the present invention, or for purposes of formulating detergent compositions some amount of linear non-branched primary alkoxylated sulfate may be admixed into the final product formulation.

It is also to be recognized that some amount of mid-chain branched alkyl sulfate may be present in the compositions. This is typically the result of sulfation of non-alkoxylated alcohol remaining following incomplete alkoxylation of the mid-chain branched alcohol used to prepare the alkoxylated sulfate useful herein. It is to be recognized, however, that separate addition of such mid-chain branched alkyl sulfates is also contemplated by the present invention compositions.

Further it is to be similarly recognized that non-sulfated mid-chain branched alcohol (including polyoxyalkylene alcohols) may comprise some amount of the present invention alkoxylated sulfate-containing compositions. Such materials may be present as the result of incomplete sulfation of the alcohol (alkoxylated or non-alkoxylated) used to prepare the alkoxylated sulfate surfactant, or these alcohols may be separately added to the present invention detergent compositions along with a mid-chain branched alkoxylated sulfate surfactant according to the present invention.

M is as described hereinbefore.

Further regarding the above formula, w is an integer from 0 to 13; x is an integer from 0 to 13; y is an integer from 0 to 13; z is an integer of at least 1; and w+x+y+z is an integer from 8 to 14.

EO/PO are alkoxy moieties, preferably selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5. The (EO/PO)m moiety may be either a distribution with average degree of alkoxylation (e.g., ethoxylation and/or propoxylation) corresponding to m, or it may be a single specific chain with alkoxylation (e.g., ethoxylation and/or propoxylation) of exactly the number of units corresponding to m.

The preferred surfactant mixtures of the present invention have at least 0.001%, more preferably at least 5%, most preferably at least 20% by weight, of the mixture one or more mid-chain branched primary alkyl alkoxylated sulfates having the formula

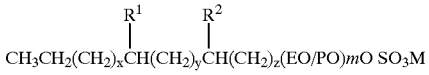

$$CH_3CH_2(CH_2)_xCH(R^1)(CH_2)_yCH(R^2)(CH_2)_z(EO/PO)mO\ SO_3M$$

wherein the total number of carbon atoms, including branching, is from 15 to 18, and wherein further for this surfactant mixture the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11; y is from 0 to 11; z is at least 2; and x+y+z is from 9 to 13; provided $R^1$ and $R^2$ are not both hydrogen; and EO/PO are alkoxy moieties selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5. More preferred are compositions having at least 5% of the mixture comprising one or more mid-chain branched primary alkoxylated sulfates wherein z is at least 2.

Preferably, the mixtures of surfactant comprise at least 5%, preferably at least about 20%, of a mid chain branched primary alkyl alkoxylated sulfate having $R^1$ and $R^2$ independently hydrogen or methyl, provided $R^1$ and $R^2$ are not both hydrogen; x+y is equal to 8, 9 or 10 and z is at least 2.

Preferred detergent compositions according to the present invention, for example one useful for laundering fabrics, comprise from about 0.001% to about 99% of a mixture of mid-chain branched primary alkyl alkoxylated sulfate surfactants, said mixture comprising at least about 5% by weight of one or more mid-chain branched alkyl alkoxylated sulfates having the formula:

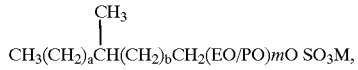

$$CH_3(CH_2)_aCH(CH_3)(CH_2)_bCH_2(EO/PO)mO\ SO_3M, \quad (I)$$

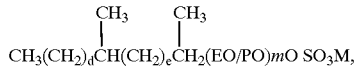

$$CH_3(CH_2)_dCH(CH_3)(CH_2)_eCH_2(EO/PO)mO\ SO_3M, \quad (II)$$

or mixtures thereof; wherein M represents one or more cations; a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12;

and wherein further for this surfactant mixture the average total number of carbon atoms in the branched primary alkyl moieties having the above formulas is within the range of greater than 14.5 to about 17.5; and EO/PO are alkoxy moieties selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5.

Further, the present invention surfactant composition may comprise a mixture of branched primary alkyl alkoxylated sulfates having the formula

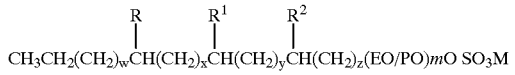

wherein the total number of carbon atoms per molecule, including branching, is from 14 to 20, and wherein further for this surfactant mixture the average total number of carbon atoms in the branched primary alkyl moieties having the above formula is within the range of greater than 14.5 to about 17.5; R, $R^1$, and $R^2$ are each independently selected from hydrogen and $C_1$–$C_3$ alkyl, provided R, $R^1$, and $R^2$ are not all hydrogen; M is a water soluble cation; w is an integer from 0 to 13; x is an integer from 0 to 13; y is an integer from 0 to 13; z is an integer of at least 1; w+x+y+z is from 8 to 14; EO/PO are alkoxy moieties, preferably selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5; provided that when $R^2$ is $C_1$–$C_3$ alkyl the ratio of surfactants having z equal to 2 or greater to surfactants having z of 1 is at least about 1:1, preferably at least about 1.5:1, more preferably at least about 3:1, and most preferably at least about 4:1. Also preferred are surfactant compositions when $R^2$ is $C_1$–$C_3$ alkyl comprising less than about 50%, preferably less than about 40%, more preferably less than about 25%, most preferably less than about 20%, of branched primary alkyl alkoxylated sulfate having the above formula wherein z equals 1.

Preferred mono-methyl branched primary alkyl ethoxylated sulfates are selected from the group consisting of: 3-methyl pentadecanol ethoxylated sulfate, 4-methyl pentadecanol ethoxylated sulfate, 5-methyl pentadecanol ethoxylated sulfate, 6-methyl pentadecanol ethoxylated sulfate, 7-methyl pentadecanol ethoxylated sulfate, 8-methyl pentadecanol ethoxylated sulfate, 9-methyl pentadecanol ethoxylated sulfate, 10-methyl pentadecanol ethoxylated sulfate, 11-methyl pentadecanol ethoxylated sulfate, 12-methyl pentadecanol ethoxylated sulfate, 13-methyl pentadecanol ethoxylated sulfate, 3-methyl hexadecanol ethoxylated sulfate, 4-methyl hexadecanol ethoxylated sulfate, 5-methyl hexadecanol ethoxylated sulfate, 6-methyl hexadecanol ethoxylated sulfate, 7-methyl hexadecanol ethoxylated sulfate, 8-methyl hexadecanol ethoxylated sulfate, 9-methyl hexadecanol ethoxylated sulfate, 10-methyl hexadecanol ethoxylated sulfate, 11-methyl hexadecanol ethoxylated sulfate, 12-methyl hexadecanol ethoxylated sulfate, 13-methyl hexadecanol ethoxylated sulfate, 14-methyl hexadecanol ethoxylated sulfate, and mixtures thereof, wherein the compounds are ethoxylated with an average degree of ethoxylation of from about 0.1 to about 10.

Preferred di-methyl branched primary alkyl ethoxylated sulfates selected from the group consisting of: 2,3-methyl tetradecanol ethoxylated sulfate, 2,4-methyl tetradecanol ethoxylated sulfate, 2,5-methyl tetradecanol ethoxylated sulfate, 2,6-methyl tetradecanol ethoxylated sulfate, 2,7-methyl tetradecanol ethoxylated sulfate, 2,8-methyl tetradecanol ethoxylated sulfate, 2,9-methyl tetradecanol ethoxylated sulfate, 2,10-methyl tetradecanol ethoxylated sulfate, 2,11-methyl tetradecanol ethoxylated sulfate, 2,12-methyl tetradecanol ethoxylated sulfate, 2,3-methyl pentadecanol ethoxylated sulfate, 2,4-methyl pentadecanol ethoxylated sulfate, 2,5-methyl pentadecanol ethoxylated sulfate, 2,6-methyl pentadecanol ethoxylated sulfate, 2,7-methyl pentadecanol ethoxylated sulfate, 2,8-methyl pentadecanol ethoxylated sulfate, 2,9-methyl pentadecanol ethoxylated sulfate, 2,10-methyl pentadecano ethoxylated sulfate, 2,11-methyl pentadecanol ethoxylated sulfate, 2,12-methyl pentadecanol ethoxylated sulfate, 2,13-methyl pentadecanol ethoxylated sulfate, and mixtures thereof, wherein the compounds are ethoxylated with an average degree of ethoxylation of from about 0.1 to about 10.

The following are representative examples of the other detergent surfactants useful in the present detergent composition. Water-soluble salts of the higher fatty acids, i.e., "soaps", are useful anionic surfactants in the compositions herein. This includes alkali metal soaps such as the sodium, potassium, ammonium. and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure a straight-chain alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred essential anionic surfactants for the detergent composition are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic.surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Adjunct Detergent Ingredients

The detergent composition of the invention can include one or more adjunct detergent ingredients as discussed herein. The compositions of the invention can contain all manner of organic, water-soluble detergent compounds, inasmuch as the builder material are compatible with all such materials. In addition to a detersive surfactant, at least one suitable adjunct detergent ingredient is preferably included in the detergent composition. The adjunct detergent ingredient is preferably selected from the group consisting of builders, enzymes, bleaching agents, bleach activators, suds suppressors, soil release agents, brighteners, perfumes, hydrotropes, dyes, pigments, polymeric dispersing agents, pH controlling agents, chelants, processing aids, crystallization aids, and mixtures thereof. The following list of detergent ingredients and mixtures thereof which can be used in the compositions herein is representative of the detergent ingredients, but is not intended to be limiting.

One or more builders can be used in conjunction with the builder material described herein to further improve the performance of the compositions described herein. For example, the builder can be selected from the group consisting of aluminosilicates, crystalline layered silicates, MAP zeolites, citrates, amorphous silicates, polycarboxylates, sodium carbonates and mixtures thereof. The sodium carbonate ingredient can serve as the inorganic alkaline material when a liquid acid precursor of the mid-chain branched surfactant is used. Other suitable auxiliary builders are described hereinafter.

Preferred builders include aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

In order to make the present invention more readily understood, reference is made to the following examples, which are intended to be illustrative only and not intended to be limiting in scope.

In the following Examples, the abbreviations for the various ingredients used for the compositions have the following meanings.

LAS: Sodium linear $C_{12}$ alkyl benzene sulfonate
$MBAS_x$: Mid-chain branched primary alkyl (average total carbons=x) sulfate
LMFAA: C12–14 alkyl N-methyl glucamide
APA: C8–C10 amido propyl dimethyl amine
Fatty Acid: C12–C14 fatty acid (C12/14)
Fatty Acid: Topped palm kernel fatty acid (TPK)
Fatty Acid: Rapeseed fatty acid (RPS)
Borax: Na tetraborate decahydrate
PAA: Polyacrylic Acid (mw=4500)
PEG: Polyethylene glycol (mw=4600)
MES: Alkyl methyl ester sulfonate
SAS: Secondary alkyl sulfate
NaPS: Sodium paraffin sulfonate
C45AS: Sodium $C_{14}$–$C_{15}$ linear alkyl sulfate
CxyEzS: Sodium $C_{1x}$–$C_{1y}$ alkyl sulfate condensed with z moles of ethylene oxide
CxyEz: A $C_{1x}$-1y branched primary alcohol condensed with an average of z moles of ethylene oxide
QAS: $R_2.N^+(CH_3)_2(C_2H_4OH)$ with $R_2=C_{12}$–$C_{14}$
TFAA: $C_{16}$–$C_{18}$ alkyl N-methyl glucamide
STPP: Anhydrous sodium tripolyphosphate
Zeolite A: Hydrated Sodium Aluminosilicate of formula $Na_{12}(AlO_2SiO_2)_{12}.27H_2O$ having a primary particle size in the range from 0.1 to 10 micrometers
NaSKS-6: Crystalline layered silicate of formula $\delta$-$Na_2Si_2O_5$
Carbonate: Anhydrous sodium carbonate with a particle size between 200 $\mu$m and 900 $\mu$m
Bicarbonate: Anhydrous sodium bicarbonate with a particle size distribution between 400 $\mu$m and 1200 $\mu$m
Silicate: Amorphous Sodium Silicate ($SiO_2$:$Na_2O$; 2.0 ratio)
Sodium sulfate: Anhydrous sodium sulfate
MA/AA: Copolymer of 1:4 maleic/acrylic acid, average molecular weight about 70,000.
CMC: Sodium carboxymethyl cellulose
Protease: Proteolytic enzyme of activity 4KNPU/g sold by NOVO Industries A/S under the tradename Savinase
Cellulase: Cellulytic enzyme of activity 1000 CEVU/g sold by NOVO Industries A/S under the tradename Carezyme
Amylase: Amylolytic enzyme of activity 60KNU/g sold by NOVO Industries A/S under the tradename Termamyl 60T
Lipase: Lipolytic enzyme of activity 100kLU/g sold by NOVO Industries AIS under the tradename Lipolase
PB4: Sodium perborate tetrahydrate of nominal formula $NaBO_2.3H_2O.H_2O_2$
PBI: Anhydrous sodium perborate bleach of nominal formula $NaBO_2.H_2O_2$
Percarbonate: Sodium Percarbonate of nominal formula $2Na_2CO_3.3H_2O_2$
NaDCC: Sodium dichloroisocyanurate
NOBS: Nonanoyloxybenzene sulfonate in the form of the sodium salt.
TAED: Tetraacetylethylenediamine
DTPMP: Diethylene triamine penta (methylene phosphonate), marketed by Monsanto under the Trade name Dequest 2060
Photoactivated: Sulfonated Zinc Phthlocyanine encapsulated in bleach dextrin soluble polymer
Brightener 1: Disodium 4,4'-bis(2-sulphostyryl)biphenyl
Brightener 2: Disodium 4,4'-bis(4-anilino-6-morpholino-1.3.5-triazin-2-yl)amino) stilbene-2:2'-disulfonate.
HEDP: 1,1-hydroxyethane diphosphonic acid
SRP 1: Sulfobenzoyl end capped esters with oxyethylene oxy and terephtaloyl backbone
Silicone antifoam: Polydimethylsiloxane foam controller with siloxane-oxyalkylene copolymer as dispersing agent with a ratio of said foam controller to said dispersing agent of 10:1 to 100:1.
DTPA: Diethylene triamine pentaacetic acid
NaCl: Sodium chloride MgSO4: Magnesium sulfate heptahydrate (or lower levels of hydration)

In the following Examples all levels are quoted as % by weight of the composition. The following examples are illustrative of the present invention, but are not meant to limit or otherwise define its scope. All parts, percentages and ratios used herein are expressed as percent weight unless otherwise specified.

EXAMPLE 1

The following laundry detergent compositions A to D are prepared in accord with the invention:

| | A | B | C | D |
|---|---|---|---|---|
| MBAS (avg. total carbons = 16.5) | 11 | 16.5 | 5.5 | 9 |
| LAS | 11 | 5.5 | 16.5 | 9 |
| Any Combination of: C45 AS, C45E1S, C16 SAS, C14–17 NaPS, C14–18 MES | — | — | — | 4 |
| C23E6.5 | 1.5 | 1.5 | 1.5 | 1.5 |
| Zeolite A | 27.8 | 27.8 | 27.8 | 27.8 |
| PAA | 2.3 | 2.3 | 2.3 | 2.3 |
| Carbonate | 27.3 | 27.3 | 27.3 | 27.3 |
| Silicate | 0.6 | 0.6 | 0.6 | 0.6 |
| Perborate | 1.0 | 1.0 | 1.0 | 1.0 |
| Protease | 0.3 | 0.3 | 0.3 | 0.3 |
| Carezyme | 0.3 | 0.3 | 0.3 | 0.3 |
| SRP | 0.4 | 0.4 | 0.4 | 0.4 |
| Brightener | 0.2 | 0.2 | 0.2 | 0.2 |
| PEG | 1.6 | 1.6 | 1.6 | 1.6 |
| Sulfate | 5.5 | 5.5 | 5.5 | 5.5 |
| Silicone Antifoam | 0.42 | 0.42 | 0.42 | 0.42 |
| Moisture & Minors | ---Balance--- | | | |

EXAMPLE 2

The following laundry detergent compositions E to F are prepared in accord with the invention:

| | E | F | G | H | I |
|---|---|---|---|---|---|
| MBAS (avg. total carbons = 16.5) | 7.2 | 8.2 | 12.3 | 4.1 | 6.2 |
| LAS | 7.2 | 8.2 | 4.1 | 12.3 | 6.2 |
| Any Combination of: C45 AS, C45E1S, C16 SAS, C14–17 NaPS, C14–18 MES | — | — | — | — | 4.0 |
| TFAA | 1.6 | — | — | — | — |
| C24E3 | 4.9 | 4.9 | 4.9 | 4.9 | 4.9 |
| Zeolite A | 15 | 15 | 15 | 15 | 15 |
| NaSKS-6 | 11 | 11 | 11 | 11 | 11 |
| Citrate | 3 | 3 | 3 | 3 | 3 |
| MA/AA | 4.8 | 4.8 | 4.8 | 4.8 | 4.8 |
| HEDP | 0.5 | 0.5 | 0.5 | 0.5 | 0.5 |
| Carbonate | 8.5 | 8.5 | 8.5 | 8.5 | 8.5 |
| Percarbonate | 20.7 | 20.7 | 20.7 | 20.7 | 20.7 |
| TAED | 4.8 | 4.8 | 4.8 | 4.8 | 4.8 |
| Protease | 0.9 | 0.9 | 0.9 | 0.9 | 0.9 |
| Lipase | 0.15 | 0.15 | 0.15 | 0.15 | 0.15 |
| Carezyme | 0.26 | 0.26 | 0.26 | 0.26 | 0.26 |
| Amylase | 0.36 | 0.36 | 0.36 | 0.36 | 0.36 |
| SRP | 0.2 | 0.2 | 0.2 | 0.2 | 0.2 |
| Brightener | 0.2 | 0.2 | 0.2 | 0.2 | 0.2 |
| Sulfate | 2.3 | 2.3 | 2.3 | 2.3 | 2.3 |
| Silicone Antifoam | 0.4 | 0.4 | 0.4 | 0.4 | 0.4 |
| Moisture & Minors | ---Balance--- | | | | |

EXAMPLE 3

The following laundry detergent compositions J to O are prepared in accord with the invention:

| | J | K | L | M | N | O |
|---|---|---|---|---|---|---|
| MBAS (avg. total carbons = 16.5) | 16 | 16 | 24 | 8 | 14 | 14 |
| LAS | 16 | 16 | 8 | 24 | 14 | 14 |
| Any Combination of: C45 AS, C45E1S, C16 SAS, C14–17 NaPS, C14–18 MES | — | — | — | — | 4 | 4 |
| C23E6.5 | 3.6 | 3.6 | 3.6 | 3.6 | 3.6 | 3.6 |
| QAS | — | 0.5 | — | — | 0.5 | — |
| Zeolite A | 9.0 | 9.0 | 9.0 | 9.0 | 9.0 | 9.0 |
| Polycarboxylate | 7.0 | 7.0 | 7.0 | 7.0 | 7.0 | 7.0 |
| Carbonate | 18.4 | 18.4 | 18.4 | 18.4 | 18.4 | 18.4 |
| Silicate | 11.3 | 11.3 | 11.3 | 11.3 | 11.3 | 11.3 |
| Perborate | 3.9 | 3.9 | 3.9 | 3.9 | 3.9 | 3.9 |
| NOBS | 4.1 | 4.1 | 4.1 | 4.1 | 4.1 | 4.1 |
| Protease | 0.9 | 0.9 | 0.9 | 0.9 | 0.9 | 0.9 |
| SRP | 0.5 | 0.5 | 0.5 | 0.5 | 0.5 | 0.5 |
| Brightener | 0.3 | 0.3 | 0.3 | 0.3 | 0.3 | 0.3 |
| PEG | 0.2 | 0.2 | 0.2 | 0.2 | 0.2 | 0.2 |
| Sulfate | 5.1 | 5.1 | 5.1 | 5.1 | 5.1 | 5.1 |
| Silicone Antifoam | 0.2 | 0.2 | 0.2 | 0.2 | 0.2 | 0.2 |
| Moisture & Minors | ---Balance--- | | | | | |

EXAMPLE 4

The following laundry detergent compositions P to S are prepared in accord with the invention:

| | P | Q | R | S |
|---|---|---|---|---|
| MBAS (avg. total carbons = 16.5) | 23.5 | 17.5 | 12 | 6.0 |
| Any Combination of: C45 AS, C45E1S, LAS, C16 SAS, C14–17 NaPS, C14–18 MES | — | 6.0 | 11.5 | 17.5 |
| C23E6.5 | — | — | — | — |
| Zeolite A | 27.8 | 27.8 | 27.8 | 27.8 |
| PAA | 2.3 | 2.3 | 2.3 | 2.3 |
| Carbonate | 27.3 | 27.3 | 27.3 | 27.3 |
| Silicate | 0.6 | 0.6 | 0.6 | 0.6 |
| Perborate | 1.0 | 1.0 | 1.0 | 1.0 |
| Protease | 0.3 | 0.3 | 0.3 | 0.3 |
| Carezyme | 0.3 | 0.3 | 0.3 | 0.3 |
| SRP | 0.4 | 0.4 | 0.4 | 0.4 |
| Brightener | 0.2 | 0.2 | 0.2 | 0.2 |
| PEG | 1.6 | 1.6 | 1.6 | 1.6 |
| Sulfate | 5.5 | 5.5 | 5.5 | 5.5 |
| Silicone Antifoam | 0.42 | 0.42 | 0.42 | 0.42 |
| Moisture & Minors | ---Balance--- | | | |

EXAMPLE 5

The following laundry detergent compositions T to X are prepared in accord with the invention:

| | T | U | V | W | X |
|---|---|---|---|---|---|
| MBAS (avg. total carbons = 16.5) | 19.8 | 21.4 | 16.3 | 10.7 | 5.1 |
| Any Combination of: C45 AS | — | — | 5.1 | 10.7 | 16.3 |

-continued

| | T | U | V | W | X |
|---|---|---|---|---|---|
| C45E1S | | | | | |
| C16 SAS | | | | | |
| C14–17 NaPS | | | | | |
| C14–18 MES | | | | | |
| TFAA | 1.6 | — | — | — | — |
| C24E3 | — | — | — | — | — |
| Zeolite A | 15 | 15 | 15 | 15 | 15 |
| NaSKS-6 | 11 | 11 | 11 | 11 | 11 |
| Citrate | 3 | 3 | 3 | 3 | 3 |
| MA/AA | 4.8 | 4.8 | 4.8 | 4.8 | 4.8 |
| HEDP | 0.5 | 0.5 | 0.5 | 0.5 | 0.5 |
| Carbonate | 8.5 | 8.5 | 8.5 | 8.5 | 8.5 |
| Percarbonate | 20.7 | 20.7 | 20.7 | 20.7 | 20.7 |
| TAED | 4.8 | 4.8 | 4.8 | 4.8 | 4.8 |
| Protease | 0.9 | 0.9 | 0.9 | 0.9 | 0.9 |
| Lipase | 0.15 | 0.15 | 0.15 | 0.15 | 0.15 |
| Carezyme | 0.26 | 0.26 | 0.26 | 0.26 | 0.26 |
| Amylase | 0.36 | 0.36 | 0.36 | 0.36 | 0.36 |
| SRP | 0.2 | 0.2 | 0.2 | 0.2 | 0.2 |
| Brightener | 0.2 | 0.2 | 0.2 | 0.2 | 0.2 |
| Sulfate | 2.3 | 2.3 | 2.3 | 2.3 | 2.3 |
| Silicone Antifoam | 0.4 | 0.4 | 0.4 | 0.4 | 0.4 |
| Moisture & Minors | | | ---Balance--- | | |

EXAMPLE 6

The following laundry detergent compositions Y to DD are prepared in accord with the invention:

| | Y | Z | AA | BB | CC | DD |
|---|---|---|---|---|---|---|
| MBAS (avg. total carbons = 16.5) | 35.6 | 35.6 | 26.6 | 17.8 | 17.8 | 9 |
| Any Combination of: | — | — | 9 | 17.8 | 17.8 | 26.6 |
| C45 AS | | | | | | |
| C45E1S | | | | | | |
| C16 SAS | | | | | | |
| C14–17 NaPS | | | | | | |
| C14–18 MES | | | | | | |
| C23E6.5 | — | — | — | — | — | — |
| QAS | — | 0.5 | — | — | 0.5 | — |
| Zeolite A | 9.0 | 9.0 | 9.0 | 9.0 | 9.0 | 9.0 |
| Polycarboxylate | 7.0 | 7.0 | 7.0 | 7.0 | 7.0 | 7.0 |
| Carbonate | 18.4 | 18.4 | 18.4 | 18.4 | 18.4 | 18.4 |
| Silicate | 11.3 | 11.3 | 11.3 | 11.3 | 11.3 | 11.3 |
| Perborate | 3.9 | 3.9 | 3.9 | 3.9 | 3.9 | 3.9 |
| NOBS | 4.1 | 4.1 | 4.1 | 4.1 | 4.1 | 4.1 |
| Protease | 0.9 | 0.9 | 0.9 | 0.9 | 0.9 | 0.9 |
| SRP | 0.5 | 0.5 | 0.5 | 0.5 | 0.5 | 0.5 |
| Brightener | 0.3 | 0.3 | 0.3 | 0.3 | 0.3 | 0.3 |
| PEG | 0.2 | 0.2 | 0.2 | 0.2 | 0.2 | 0.2 |
| Sulfate | 5.1 | 5.1 | 5.1 | 5.1 | 5.1 | 5.1 |
| Silicone Antifoam | 0.2 | 0.2 | 0.2 | 0.2 | 0.2 | 0.2 |
| Moisture & Minors | | | ---Balance--- | | | |

Having thus described the invention in detail, it will be clear to those skilled in the art that various changes may be made without departing from the scope of the invention and the invention is not to be considered limited to what is described in the specification.

What is claimed is:

1. A granular detergent composition comprising:

(A) a linear alkylbenzene sulfonate surfactant;

(B) a mid-chain branched surfactant, wherein the weight ratio of said linear alkylbenzene sulfonate surfactant to said mid-chain branched surfactant is from about 1:3 to about 4:1;

(C) a linear alkyl sulfate surfactant, wherein the weight ratio of said linear alkylbenzene sulfonate surfactant to said linear alkyl sulfate surfactant is from about 2:1 to about 20:1;

(D) up to about 5% by weight of an alkyl ethoxylate surfactant; and (E) up to about 5% by weight of an alkyl ethoxylated sulfate surfactant;

wherein said mid-chain branched surfactant has the formula $$A^b—X—B$$

wherein (a) $A^b$ is a hydrophobic C9 to C22, mid-chain branched alkyl moiety having: (1) a longest linear carbon chain attached to the —X—B moiety in the range of from 8 to 21 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 2 carbon, counting from carbon #1 which is attached to the —X—B moiety, to position ω–2 carbon, the terminal carbon minus 2 carbons; and (4) the surfactant composition has an average total number of carbon atoms in the $A^b$—X moiety in the above formula within the range of greater than 14.5 to about 18;

(b) B is a hydophilic moiety selected from the group consisting of sulfates, sulfonates, amine oxides, polyoxyalkylene, alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated quats, alkylated/polyhydroxylated oxypropyl quats, imidazolines, 2-yl-succinates, sulfonated alkyl esters, and sulfonated fatty acids; and (c) X is —$CH_2$—.

2. A composition according to claim 1 wherein said weight ratio of said linear alkylbenzene sulfonate surfactant to said mid-chain branched surfactant is from 1:1 to 3:1.

3. A composition according to claim 1 wherein the weight ratio of said linear alkylbenzene sulfonate surfactant to said linear allyl sulfate surfactant is from 0.8:1 to 1.5:1.

4. A composition according to claim 1 wherein said composition is substantially free of alkyl ethoxylate sulfate and alkyl ethoxylate surfactants.

5. A composition according to claim 1 further characterizing an adjunct detergent ingredient selected from the group consisting of polyethylene glycol, polyacrylate and mixtures thereof.

6. A composition according to claim 1 wherein said alkyl ethoxylate surfactant is present in an amount of from 0.01% to 4% by weight of said composition.

7. A composition according to claim 1 wherein said alkyl ethoxylate surfactant is present in an amount of from 0.1% to 3% by weight of said composition.

8. A composition according to claim 1 further including adjunct detergent ingredients selected from the group consisting of builders, enzymes, fillers, brighteners, bleaching agents and mixtures thereof.

9. A composition according to claim 1 wherein the $A^b$ moiety is a branched primary alkyl moiety having the formula:

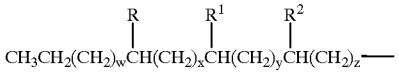

wherein the total number of carbon atoms in the branched primary alkyl moiety of this formula, including the R, $R^1$, and $R^2$ branching, is from 13 to 19; R, $R^1$, and $R^2$ are each independently selected from hydrogen and $C_1$–$C_3$ alkyl, provided R, $R^1$, and $R^2$ are not all hydrogen and, when z is 0, at least R or $R^1$ is not hydrogen; w is an integer from 0 to 13; x is an integer from 0 to 13; y is an integer from 0 to 13; z is an integer from 0 to 13; and w+x+y+z is from 7 to 13.

10. A composition according to claim 1 wherein the $A^b$ moiety is a branched primary alkyl moiety having the formula selected from:

(I)

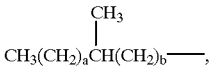

(II)

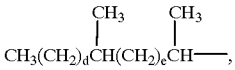

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

11. A method of laundering soiled fabrics comprising the step of contacting said soided fabrics with an effective amount of a composition according to claim 1 in an aqueous solution.

* * * * *

UNITED STATES PATENT AND TRADEMARK OFFICE

CERTIFICATE OF CORRECTION

PATENT NO. : 6,380,143 B1 
DATED : April 30, 2002
INVENTOR(S) : Frank Andrej Kvietok, Gabor Heltovics, Rinko Katsuda and Kenneth William Willman It is certified that error appears in the above-identified patent and that said Letters Patent is hereby corrected as shown below:

Title page,
Item [60], Related U.S. Application Data, replace "Provisional application No. 60/061,881, filed Oct. 10, 1997" with -- Provisional application No. 60/061,880, filed on Oct. 10, 1997 --.

Column 26,
Line 50, replace "allyl" with -- alkyl --

Column 28,
Line 30, replace "soided" with -- soiled --

Signed and Sealed this

Fifteenth Day of October, 2002

*Attest:*

*Attesting Officer*

JAMES E. ROGAN
*Director of the United States Patent and Trademark Office*